United States Patent [19]

McLelland et al.

[11] Patent Number: 5,031,701

[45] Date of Patent: Jul. 16, 1991

[54] SUPPRESSANT DISCHARGE NOZZLE FOR EXPLOSION PROTECTION SYSTEM

[75] Inventors: Bruce McLelland; Robert L. DeGood; Ian Swift, all of Blue Springs, Mo.

[73] Assignee: Fike Corporation, Blue Springs, Mo.

[21] Appl. No.: 187,280

[22] Filed: Apr. 28, 1988

[51] Int. Cl.[5] ..... A62C 37/14

[52] U.S. Cl. ..... 169/58; 169/28; 169/66; 169/68; 169/26; 137/68.2; 220/88.1

[58] Field of Search ..... 169/61, 62, 28, 66, 169/68, 58, 26; 137/68.1, 68.2; 220/88.1, 88.3

[56] References Cited

U.S. PATENT DOCUMENTS

| | | | |
|---|---|---|---|
| 1,261,922 | 4/1918 | Grasty et al. | 169/61 |
| 1,746,844 | 2/1930 | Reddemann | 169/68 |
| 4,328,867 | 5/1982 | Heath | 169/58 |
| 4,394,868 | 7/1983 | McLelland | 169/58 |
| 4,637,472 | 1/1987 | Decima | 169/28 |
| 4,702,322 | 10/1987 | Richardson | 137/68.2 |

FOREIGN PATENT DOCUMENTS

| | | | |
|---|---|---|---|
| 985651 | 3/1965 | United Kingdom | 137/68.2 |

*Primary Examiner*—Sherman Basinger
*Assistant Examiner*—Christopher P. Ellis
*Attorney, Agent, or Firm*—Hovey, Williams, Timmons & Collins

[57] ABSTRACT

A suppressant delivery and release nozzle structure is disclosed for an explosion protection system. The nozzle is a reducing elbow, concentric or eccentric mounting a rupture disc at its small end. A selectively actuatable detonator housed in the nozzle adjacent the disc permits substantially instantaneous opening of the disc upon command for release and delivery of suppressant to a zone to be protected from an explosion hazard. The configuration of the nozzle assures unimpeded discharge of suppressant from the system in a minimum of time without significant two-phase flow. The nozzle is equally adaptable for liquid or powdered suppressant compositions.

18 Claims, 2 Drawing Sheets

10
12
14
16
18
20
22
24
26
28
30
32
34
36
38
40
42
44
46
48
52
54
56
58
60
62
64
66
68
70
72
74
76

10
12
18
20
22
24
26
28
30
36
42
44
46
50
76

110
114
118
120
126
152
176

210
212
214
218
220
276
278
280
282
284

SUPPRESSANT DISCHARGE NOZZLE FOR EXPLOSION PROTECTION SYSTEM

BACKGROUND OF THE INVENTION

1. Field of the Invention

This invention relates to explosion protection systems, such as explosion suppression and explosion isolation equipment. It is particularly concerned with nozzle structure for improved outflow of a liquid or powdered suppressant upon release of the suppressant from a contained supply thereof.

2. Description of the Prior Art

Explosion protection systems gained widespread commercial acceptance after World War II following intensive efforts to suppress combat aircraft fuel tank explosions. Prior to this work, it was widely believed sensing of an incipient explosion could not be accomplished at a fast enough rate to prevent the event from occurring.

Research undertaken in England during the war confirmed that the pressure rate rise in an explosion followed a parabolic type curve. It was demonstrated that if the pressure increase could be adequately sensed during the initial, flatter part of such curve before the pressure started to increase rapidly and exponentially, there was a possibility of preventing an explosion provided the suppressant medium could be delivered to the threatened site during the very first part of the pressure buildup.

Initial studies were directed toward extremely rapid sensing of the pressure rise associated with an incipient explosion. Pressurized detectors capable of detecting a pressure rise within 50 milliseconds after initiation of an event leading to an explosion were soon developed but equipment capable of delivering a suppressant medium to the threatened area within a required short time interval lagged behind detector technology. Pressure detectors now are capable of detecting a 0.25 psi increase in pressure in a time interval of no more than about 2 milliseconds.

Forty years later, efforts are still being made to solve the multiplicity of problems which have been discovered relating to release and delivery of a suppressant medium after detection of a pressure rise indicating that an explosion is about to occur. Many studies have focused on the means to effect release of a suppressant upon command after a pressure rise has been detected. Mechanical valves were first used but they proved to be too slow in operation and also suffered from leakage defects over the long static storage periods required for explosion suppression systems. Equipment of this type must sit in a dormant state and perhaps never operate, but when called upon to do so, function without fail in the required ultra-short reaction time.

The most successful release devices for explosion protection systems have been rupture discs hermetically sealing the delivery opening of a suppressant containment vessel. A shock wave producing device such as an electrically operated explosive initiator or detonator is mounted in proximal relationship to the rupture disc to effect rupture thereof upon receipt of an operating command from a sensing device such as a pressure rise detector.

The functionality and reliability of explosion protection systems has significantly benefited from the use of fluorinated hydrocarbons (e.g., du Pont's HALON 1301), not only from the standpoint of the ability of the HALON to quickly suppress an incipient explosion, but equally as important, because the gaseous product has a low toxicity level. Thus, a system for protecting areas from explosions may be designed even where people occupy the locale.

Explosion protection systems which utilize HALON as the suppressant medium normally embody a containment vessel for confining the suppressant as a liquid under pressure. The HALON is generally held under an applied pressure of compressed gaseous nitrogen also contained in the vessel at a pressure of about 360 psi causing the suppressant to be maintained at its vapor pressure of about 200 psi.

In a typical system, an elongated suppressant delivery or discharge pipe or elbow is connected to the spherical, cylindrical or other pressure containing vessel which is used to store the suppressant medium until a release command is received from a pressure detector or other device capable of sensing the onset of an explosion. The rupture disc closing the outermost end of the discharge pipe or elbow is fully and substantially instantaneously opened upon actuation of the associated electrically operated detonator. An exemplary elbow construction is shown in U.S. Pat. No. 4,394,868 of July 26, 1983 and assigned to the assignee hereof.

It has now been discovered that upon release of HALON conventional protections release tem, flow of the HALON through a discharge pipe from a storage tank takes place as two-phase turbulent flow where gas bubbles are intimately mixed with the liquid. Skilled workers in the explosion protection field have heretofore failed to adequately appreciate and recognize that this turbulent flow significantly increased the overall suppressant discharge time. In fact, many systems now being commercialized have exacerbated the problem by providing long lengths of pipes leading from remote suppressant storage vessels to a discharge orifice many feet from the containment unit. In addition, the piping arrangements frequently had a number of elbows in the delivery path which further aggravated the unrecognized turbulent flow problem.

Suppressant flow restriction and increased flow time occurs whenever any part of the initially liquid suppressant is permitted to vaporize prior to ejection from the delivery pipe or nozzle. Turbulent or choke flow thus occurs whenever gas bubbles are allowed to form in the liquid before release of the liquid from the system.

The dynamics of flashing flow regimes have been studied in depth in recent years by a number of investigators including Hans K. Fauske, Robert E. Henry, J. C. Leung and M. A. Grolmes of Fauske & Associates, Burr Ridge, Ill. Their work, conducted in part under the auspices of the American Institute of Chemical Engineers (AIChE) through a research program known as the Design Institute for Emergency Relief Systems (DIERS) demonstrated that two-phase flow can have a profound effect on the time required for an initially liquid material to be exhausted from a contained vessel. Although the DIERS study was directed to emergency relief in the case of a runaway chemical reactor, the work is instructive from the standpoint that it confirmed that flashing flows are generally always choked and turbulent in nature. Theoretical equations for such flows are described in a paper by Leung and Grolmes published in the March 1987 AIChE Journal, Vol. 33, No. 3, which references in part Leung's article in Vol. 32, No. 10 of the AIChE Journal published in 1986 and entitled "A Generalized Correlation for One-Component Homogeneous Equilibrium Flashing Choked Flow." These correlations make it clear that two-phase flow is very complex and highly dependent on a number of ambient environment parameters including temperature and pressure of the composition to be ejected, and the ratio of gas to liquid in the flow regime.

SUMMARY OF THE INVENTION

It has now been discovered that the time required to deliver a defined quantity of a suppressant from a containment vessel to a potential explosion site can be significantly decreased by substantially eliminating two-phase flow of the suppressant at any point within the delivery path.

Specifically, this invention is concerned with the provision of novel nozzle structure which is constructed and arranged to preclude any tendency for a suppressant to vaporize and produce bubbles in the liquid suppressant which contribute to two-phase choked, turbulent flow that increases the discharge time for the suppressant from its vessel and associated discharge piping or nozzle units.

Substantial elimination of two-phase flow upon discharge of an explosion suppressant composition such as HALON 1301 is accomplished by the provision of a discharge nozzle which uniformly decreases in diameter as the discharge orifice thereof is approached thereby avoiding any tendency for the otherwise liquid composition to vaporize and form bubbles which result in two-phase turbulent flow.

The discharge nozzle is configured and located such that it is always filled with at least a part of the explosion suppressant composition to be discharged from the storage zone, so that there is no opportunity for the suppressant to vaporize upon release thereof through the nozzle, prior to exhaustion of suppressant through the nozzle.

A reducing elbow, a concentric or an eccentric reducer of conventional design may be used as the discharge nozzle, thereby avoiding the necessity of manufacturing special parts for these components. Flange means mounted on the smallest end of the nozzle reducer serves as means for mounting a hermetically sealed rupture disc which may be fully opened upon command by pressure sensing or other means capable of detecting the onset of a condition which if allowed to proceed will result in an explosion or the like.

The reducer, provided with closure means at the end thereof opposite the small end mounting the rupture disc, may itself serve as the containment vessel for the suppressant medium maintained under an ejection enhancement medium such as compressed gaseous nitrogen.

The amount of suppressant that can be stored may readily be increased by the simple expedient of attaching a conventional cylindrical pipe or the like to the larger end of the reducer, with an end cap then being suitably secured to the extremity of the pipe remote from the reducer. Similarly, the storage capacity may be increased without sacrifice of discharge rate by mounting a stepped tubular member on the reducer of a shape such that the cross-sectional area of the storage container and associated reducer always decrease as the discharge orifice of the suppressant system is approached thereby preventing flow of the suppressant through any containment surfaces which increase in cross-sectional area or remain of the same diameter to any significant extent.

A particularly important aspect of the invention is the fact that although the main feature of the design is the ability to more quickly effect discharge of a pressurized liquid such as HALON 1301 from a storage vessel through a unique discharge nozzle, the structure may be used to deliver a powdered suppressant to an area to be protected from an explosion, without any modification of the suppressant system.

DETAILED DESCRIPTION OF THE INVENTION

Figure 1:
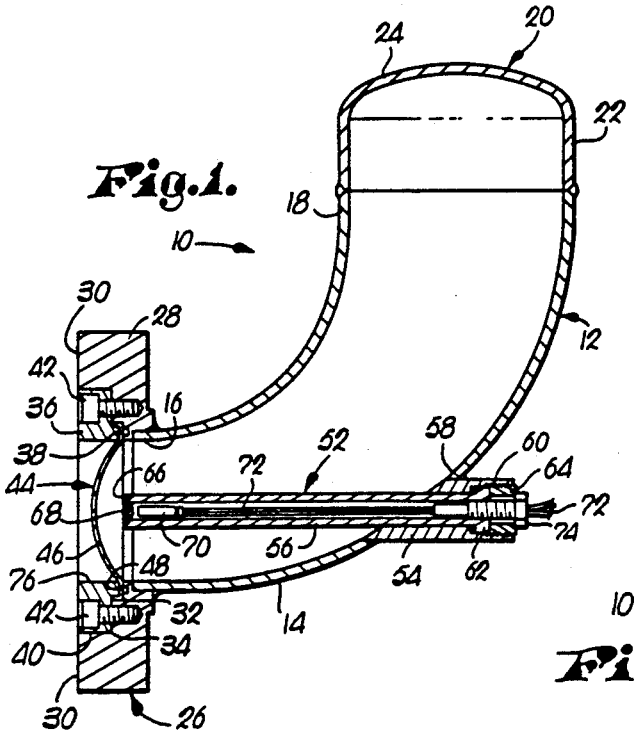
FIG. 1 is a vertical cross-sectional view of tubular nozzle structure comprising a reducing elbow mounting a hermetically sealed rupture disc over the smaller end thereof, closed with an end cap permitting use of the elbow as a suppressant containment vessel, and supporting disc opening means in the nature of a detonator supported adjacent the rupture disc by a tube extending into the interior of the elbow.
Figure 2:
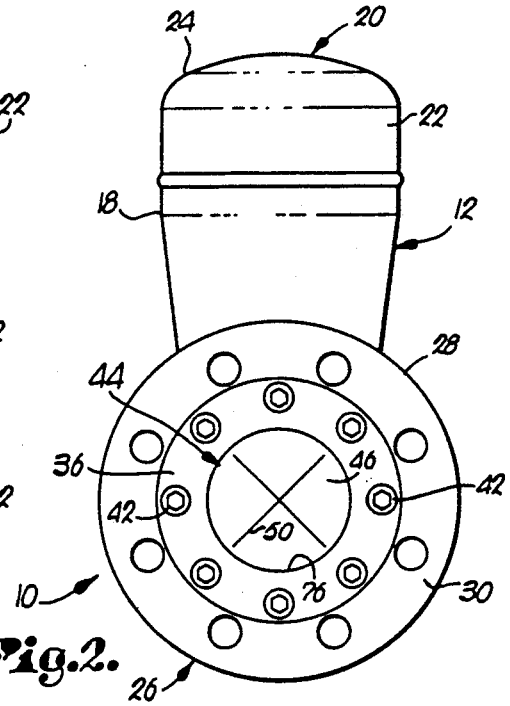
FIG. 2 is a front elevational view of the nozzle structure as depicted in FIG. 1.

Referring initially to FIG. 1 of the drawings, a combination suppressant storage and nozzle unit generally designated 10 is illustrated in vertical cross-section.

Tubular nozzle structure broadly designated 12 is preferably a conventional reducing long elbow 14 which may have a small diameter circular end 16 of a diameter for example of 4 inches I.D. and a large circular end 18 of approximately 6 inches I.D. Welded onto the large end 18 of elbow 14 is a conventional end cap 20 having a cylindrical side wall 22 and a dome-shaped end wall 24.

Flange structure broadly designated 26 is provided at the small end of reducer 14 and may take the form of a flange 28 welded to small diameter end 16 in circumscribing relationship thereto.

The internal cylindrical diameter of flange 28 concentric with the axis of end 16 is of stepped configuration presenting grooves of increasing diameter as the outer face 30 of the flange is approached. The first, innermost step 32 of flange 28 meets with an outer large diameter step 34.

An annular stepped ring 36 is configured to be received within the stepped opening of flange 28 and thereby has an inner shoulder 38 of dimensions to be complementally received within step 32. The major portion 40 of ring 36 is likewise complementally received within the step 34 of flange 28. Means for removably securing the ring 36 to flange 28 takes the form of a series of threaded studs 42 which extend through ring 36 and are threaded into flange 28.

A bulged rupture disc 44 is clamped in the flange structure 26 between ring 36 and the flange 28. Disc 44 has a concavo-convex central rupture section 46 with the convex surface thereof facing outwardly. A transversely L-shaped lip portion 48 received between ring 36 and flange 28 and is clamped against step 32 with the outer upturned extremity of the section 48 extending toward outer step 34 in order to assure a fluid tight seal when the disc 48 is secured in place within flange structure 26. Preferably, disc 44 is fabricated of relatively thin metal material such as stainless steel of uniform thickness so that controlled bursting thereof is assured. In order to enhance full opening of disc 44 upon command, the concavo-convex section 46 may be scored with a cross pattern 50 thus causing the disc to open in four leaves providing a substantially unimpeded flow relief passage through the end 16 of nozzle structure 12.

Opening of disc 44 upon command is preferably accomplished by a provision of initiator or detonator assembly broadly designated 52. A tubular boss 54 welded to elbow reducer 14 and communicating with the interior thereof mounts an elongated initiator support tube 56. It is noteworthy in this respect that the inner extremity of boss 54 is oblique and surfaced such that it is smoothly complemental with the interior rounded surface 58 of elbow reducer 14. The outer end of boss 54 is internally stepped as at 60 for receipt of the complementally flanged outer end 62 of the detonator support tube 56 which is telescoped therein. The internally stepped surface 60 of boss 54 is threaded for receipt of an annular stop nut 64.

The innermost end 66 of detonator support tube 56 terminates adjacent rupture disc 54 as depicted in FIG. 1 and preferably is disposed substantially at the point of engagement of the innermost face of ring 36 with the inner step 32 of flange 28. A small rupture disc 68 silver soldered to the innermost end 66 of support tube 56 serves to hermetically seal the interior of storage nozzle unit 10 and prevent outflow of suppressant through the assembly 52.

An electrically actuated initiator or detonator 70 is positioned within tube 56 adjacent disc 68 and has leads 72 which lie within tube 56 and exit from boss 54 through the fitting 74 threaded into the flanged part of tube 56.

Although not depicted, it is understood that the nozzle structure 12 is desirably provided with a nipple fitting on the side wall 14 having a removable threaded cap thereon allowing filling of the interior of the structure 12 with a suitable liquid suppressant such as HALON 1301 under pressure. The fitting also serves to permit the introduction of compressed gaseous nitrogen which by virtue of the difference of density thereof as compared with that of HALON 1301 causes the nitrogen to be contained at the top of the unit 10 in overlying relationship to the suppressant. The HALON is normally held under an applied pressure of compressed gaseous nitrogen at a pressure of about 360 psi whereby the suppressant is maintained at its vapor pressure of about 200 psi. Furthermore, the HALON 1301 if contained within unit 10 under a nitrogen pressure of about 360 psi will be about 90% in liquid form and about 10% in gaseous form between the liquid level and the layer of nitrogen. If desired, a pressure gauge may be provided on the side wall 14 of nozzle structure 12 in communication with the interior of the reducer 14 in order to permit observation of the pressure within the unit 10 at any desired time.

In the use of unit 10, an explosion protection system will normally include a device for sensing an incipient explosion. This may take the form of a pressure rise detector, an infrared detector, or other suitable means to indicate the onset of an explosion. Most frequently, systems rely upon pressure detectors for this purpose because of the reliability of such detectors and the fact that they are well adapted to effect closing of a switch upon shifting of a pressure sensitive diaphragm which activates an electrical circuit for electrical triggering of the detonator 70.

The unit 10 is disposed such that discharge of suppressant therefrom will impinge directly on the area to be protected from an explosion. Thus, if it is desired for the suppressant to be dispersed other than vertically or horizontally as shown in FIG. 1, a suitable deflector may be provided in association with flange structure 26 to divert the suppressant in any desired direction after delivery thereof from the unit 12. Deflectors of various sizes and shapes may be used; e.g., a curved fan shaped deflector may advantageously be used in certain applications. If the deflector is tubular in construction, it should be of dimensions which do not cause upstream turbulent outflow of suppressant from the nozzle structure 10.

When an electrical command signal is sent to the detonator 70 from the pressure sensitive detector or the like, actuation of the detonator opens disc 68 causing the shock wave to directly impinge on the concave face of rupture disc 44 thereby causing the latter to open fully in the form of four individual petals. Instantaneous release of the pressurized suppressant such as HALON 1301 allows delivery of the suppressant from the interior of unit 12 as the suppressant flows outwardly through opening 16 and ring 36.

Because the reducer 14 is filled with suppressant, or at least there are no parts of the reducing elbow filled with suppressant which do not decrease in diameter as the small circular end 16 thereof is approached, the liquid suppressant is maintained in liquid form throughout the time of discharge and there is no tendency for such liquid as the pressure is released thereon to vaporize and form bubbles in the liquid causing turbulent, choked two-phase flow. Although the interior cylindrical surface 76 of ring 36 in a preferred embodiment does not decrease in diameter as the outer extremity of the ring is approached, such construction could be provided if desired. It has been found though that the length of passage 76 is of such short dimension axially thereof that the outrush of suppressant is so great that there is no opportunity for the liquid to vaporize and to form two-phase turbulent flow which would interfere with release of the suppressant and thereby decrease its delivery time.

Improved suppressant delivery rates have been accomplished using the constantly reducing diameter elbow 14 of the present invention as compared with the 90° elbow previously employed. In an exemplary system, as previously indicated, sensing of a ¼ pound pressure rise can readily be accomplished within 5 milliseconds and in many instances at times of the order of 2 milliseconds. A 1 millisecond time loss is normally encountered in the electronic control panel where a check must be carried out to make certain that the detector has sensed a condition calling for discharge of suppressant. Once the command signal has been sent to the detonator, there is a finite period of time involved in firing of the initiator. Generally, this time loss is of the order of three milliseconds. Accordingly, 5 to 6 milliseconds elapse in detection of pressure rise or other indication of an impending explosion and activation of the detonator.

The next elapsed time is the most critical because as previously pointed out, the pressure rise curve of an explosion is somewhat parabolic in shape. Thus, the longer the time period after initiation of the event, the closer the pressure rise comes to the time where it increases exponentially. Accordingly, the faster suppressant can be delivered to the site to be protected, the more likely that effective protection can be afforded.

Using a conventional long radius 90° elbow of uniform internal diameter throughout its length of 3.063 inches, and a longitudinal dimension of about 9 inches (measured along the centerline of the passage through the elbow), tests showed that the time required to effect discharge of HALON from a 1.8 liter storage container (6 pounds of HALON 1301) was at least about 120 milliseconds. A 7 liter storage bottle (containing about 24 pounds of HALON 1301) required at least about 190 milliseconds for the contents of the containment vessel to be expelled. In view of this data, an average expulsion time of about 180 milliseconds can be routinely used in planning explosion protection installations and advising users of the potential of the system.

When a reducing elbow was used as depicted in FIG. 1 having a 4 inch outlet and a maximum diameter of 6 inches overall, the discharge time for the HALON suppressant was found to be no more than about 45 milliseconds. The reduction in discharge time was therefore much greater than could be attributed simply to the dimensional differences between the 3 inch diameter discharge orifice of the conventional long radius 90° elbow tested as compared with the 4 inch diameter of orifice 16 of the 4–6 inch reducing elbow 14.

These studies led to the understanding that it is desirable to maintain the ratio of the length of the centerline of the passage for discharge of a liquid suppressant such as HALON 1301 under pressurized containment calculated on the basis of the length of the passage that is of uniform cross-sectional area, with respect to the diameter of the final orifice through which the suppressant is delivered. This L/D ratio should be maintained at a value no greater than 1 and preferably less than 0.5. In the instance of the 90° uniform internal diameter elbow compared with the reducing elbow discharge nozzle of this invention, the L/D ratio (9/3=3) is far greater than 1. On the other hand, using a 4–6 inch reducing elbow, and 1½ inch thick flange as depicted in FIG. 1, wherein the length of the passage 76 of equal diameter throughout its length presented by the flange 26 is no more than about 1½ inches, the L/D ratio is 1.5/4=0.37.

For economy, it is desirable to use steel reducing elbows commercially available on the market. The 4–6 inch reducing elbow of the preceding test is a unit that can be purchased on the open market. Other reducing elbows of different sizes are also readily available.

Figure 3:
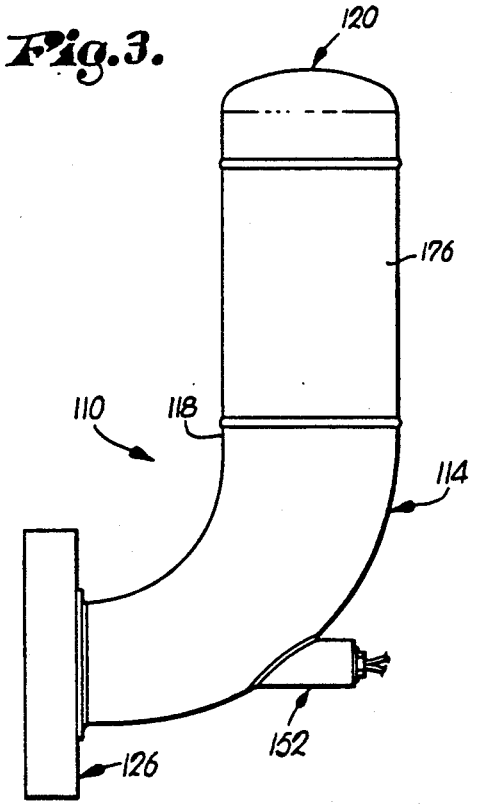
FIG. 3 is a side elevation view of a modified form of the invention, wherein the nozzle structure is of the general type shown in FIG. 3, and a cylindrical extension in the form of a pipe is mounted between the end cap and the larger end of the reducer to increase the storage capacity of the suppressant containment vessel defined thereby.

The use of reducing elbow 14 permits ready variation of the amount of suppressant that may be contained for release to a particular area to be protected. For example, in FIG. 3, the modified suppressant storage and nozzle unit 110 has a reducing elbow 114, flange structure 126, an initiator within assembly 152, and a rupture disc which are identical to the same components as illustrated in FIG. 1. In this instance though, a length of conventional 6 inch pipe 176 is welded between the largest end 118 of elbow 114 and the end cap 120 which is identical to cap 20. It can be appreciated that pipe section 176 can be of any desired length depending upon the volume of suppressant required for a particular application.

Of primary importance though is the fact that there are no internal surfaces within the unit 110 that increase in cross-sectional diameter, and then decrease before discharge of the suppressant through the final outlet orifice. The internal diameter stays the same, or then uniformly decreases as the discharge opening is approached to assure that there is no tendency for the suppressant to vaporize when the rupture disc opens thereby exposing the confined suppressant to the lower atmospheric pressure.

Figure 4:
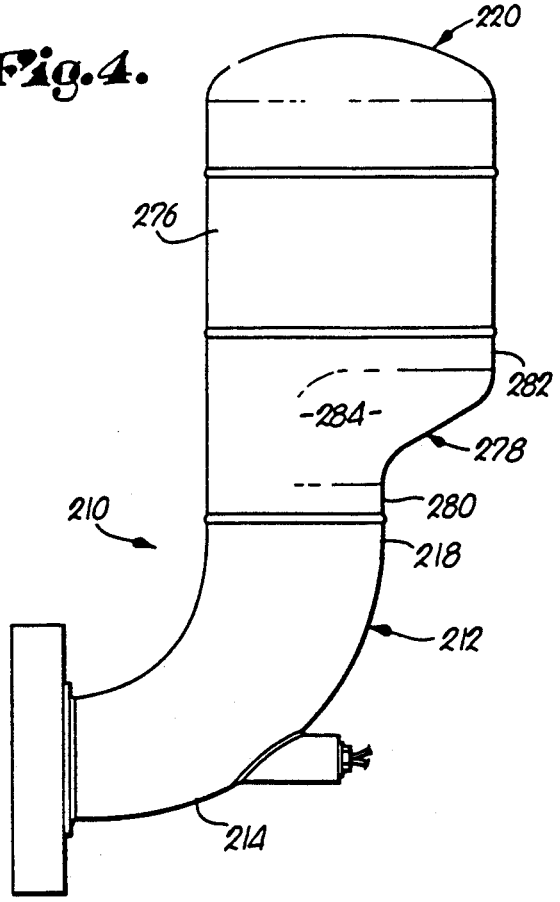
FIG. 4 is a further modified form of the invention having increased suppressant storage capacity by provision of a stepped tubular adapter on the large end of the reducer and a cylindrical extension in the form of a pipe between the adapter and end cap thereon.

In FIG. 4, a suppressant storage and nozzle unit 210 represents a further modification of the invention. The nozzle structure 212 is identical to nozzle structure 12. However, a stepped adapter 278 (sometimes referred to as a type of eccentric reducer) is welded to the upper large end 218 of elbow 214 in order to increase the suppressant storage capacity of the system. In the case where a 4–6 inch reducing elbow 214 is employed, the adapter 278 may be a 6–10 inch eccentric reducer. The small diameter end 280 of adapter 278 is of a dimension to complementally fit with the end 218 of reducing elbow 214 while the upper large diameter end 282 of adapter 278 is of particular dimensions to provide the necessary volume of suppressant. Again, adapter 278 is a conventional item used to reduce from one diameter of cylindrical pipe to another. A conventional end cap 220 as illustrated in FIG. 4 may be welded direct to the large end 282 of adapter 278, or if desired, and optionally, a pipe section 276 may be interposed between end 282 of adapter 278 and the cap 220. As with unit 110, wherein the length of intermediate pipe section 176 may be of any desired length, the length of pipe section 276 may be varied at will to change the volume of contained suppressant.

The stepped or eccentric reducing adapter 278 has interior walls which provide a smooth uninterrupted transition from the larger diameter of end 282 leading toward the small diameter end 280. In all instances, the interior, intermediate cross-sectional diameter of the midsection 284 of adapter 278 decreases uniformly between the large end 282 and the small end 280.

Figure 5:
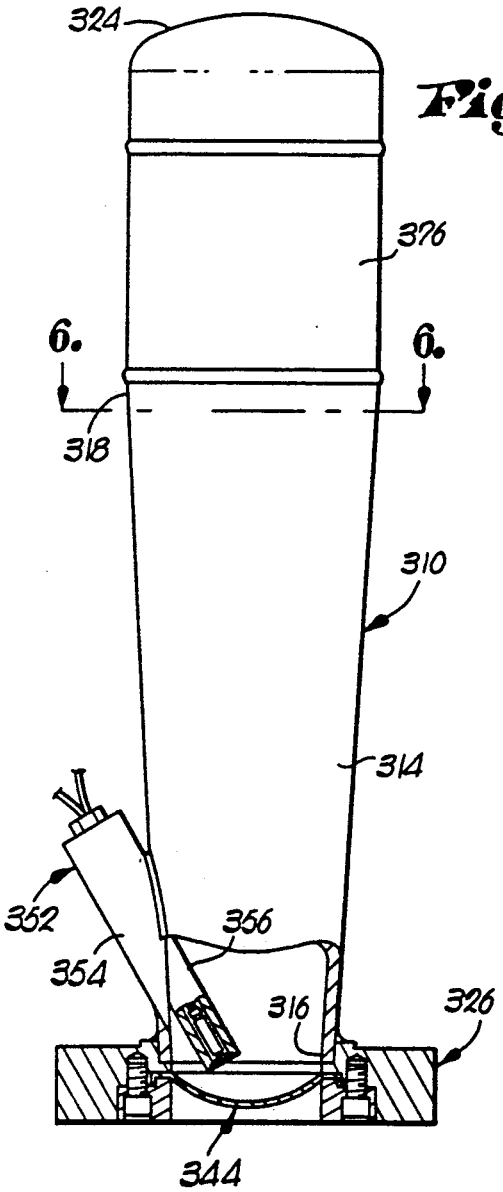
FIG. 5 is another modified form of the invention employing a reducing concentric as the nozzle structure while a cylindrical extension secured to the large end of the reducer between the latter and the end cap serves to increase the stored suppressant volume.
Figure 7:
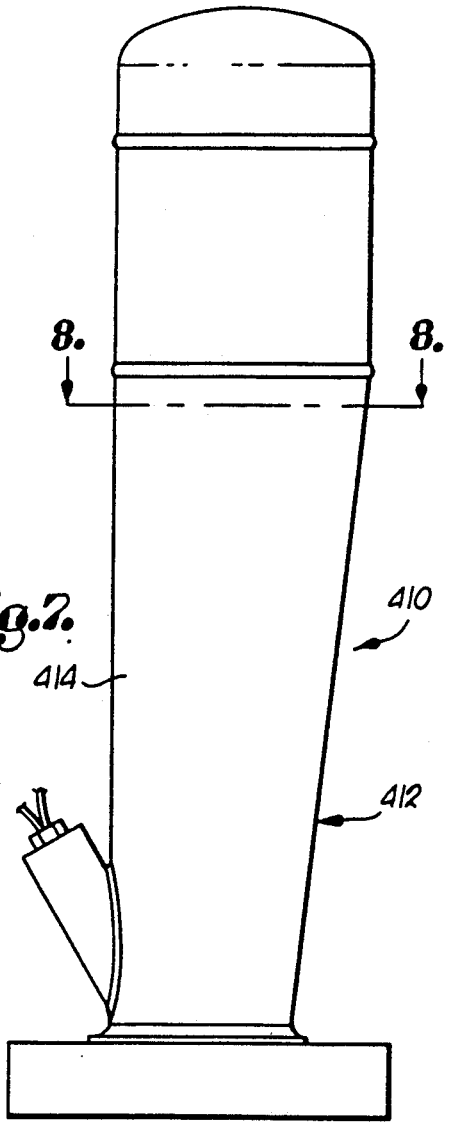
FIG. 7 is a further modified form of the invention similar to FIG. 5 but utilizing a reducing eccentric as the nozzle structure.
Figure 6:
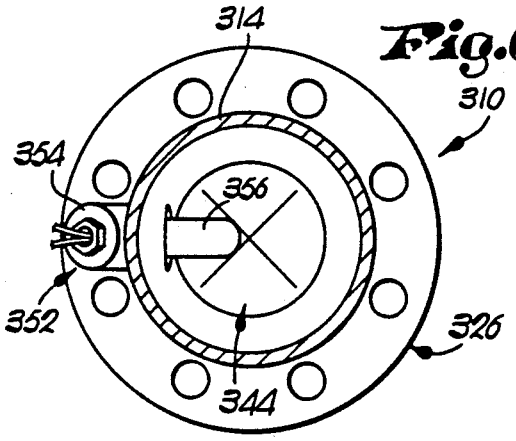
FIG. 6 is a horizontal cross-sectional view taken substantially on the line 6—6 of FIG. 5.

FIGS. 5 and 7 illustrate other suppressant storage and nozzle units that embody the principles of the present invention. In the embodiment of FIGS. 5 and 6, suppressant storage and nozzle unit 310 is a 4–6 inch unstepped concentric pipe reducer 314 which has flange structure 326 on the small end 316 of the pipe concentric mounting a rupture disc 344, all of which are of identical construction to that of flange 26. The only difference in constructional details is the length and disposition of boss 354 forming a part of initiator housing 352. The boss 354 corresponds to boss 54 of unit 10. Tube 356 forming a part of initiator housing 352 is of somewhat different length than tube 56. Here again though, the boss 354 welded to the side wall of the pipe concentric 314 at an angle such that the tube 356 carried thereby does not significantly impede free flow of liquid suppressant from the concentric through the orifice defined by flange 326 upon opening of rupture disc 344.

The end cap 324 is the same as end cap 24, and again a conventional 6 inch pipe section 376 may be interposed between end cap 324 and the large end 318 of concentric reducer 314.

Figure 8:
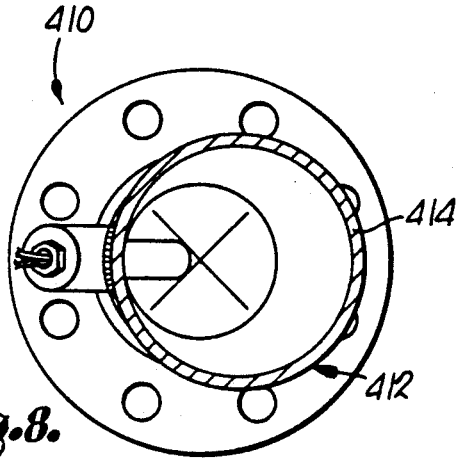
FIG. 8 is a horizontal cross-sectional view taken substantially on the line 8—8 of FIG. 7.

Unit 410 illustrated in FIGS. 7 and 8 is the same as embodiment 310 except that the nozzle structure 412 is made up of an unstepped eccentric pipe reducer 414 as a replacement for the concentric reducer 314. Otherwise, the components are the same as those of unit 310.

Although the units 10–410 inclusive are especially adapted for containment and controlled discharge of a liquid suppressant such a HALON 1301, a particularly important feature of the units is the fact that if desired, a solid powdered composition may be used as a suppressant medium in lieu of a liquid. Useful powder suppression agents in this respect include boric acid, monoammonium phosphate and sodium bicarbonate. Disposition of the initiator 70 in close proximity to the rupture disc 44 causes the shock wave produced thereby upon actuation of the detonator to impinge directly on the concave face of the disc to effect instantaneous full opening thereof without dissipation of the energy produced by the detonation. Although detonator 70 would not have to be located as close to rupture disc 44 as illustrated in unit 10 of FIG. 1 where nozzle structure 12 is used in a liquid suppressant application, the construction as depicted is preferred because it makes the unit universally usable for both liquids and powders without modification.

The improved high rate discharge nozzle structure of this invention also has utility for explosion protection systems which function as isolation devices. For example, if a grinding machine has a dust duct leading to an outside dust collector such as a bag house, an explosion in the collector unit can have catastrophic consequences inside of the building where the grinding machine is located. This can be especially dangerous to workers around the grinding machine. Although bag houses are generally equipped with explosion relief vents, when an explosion does occur, it is possible that the gaseous combustion products generated, even though substantially vented from the bag house through the relief openings in the collector house, will be at a high enough pressure level to cause gasses and even the flame front itself to back flow through the duct work connecting the grinding machine or machines to the dust collector unit. This can result in an explosion inside the grinding machine.

In order to preclude such event from happening, a protection system can be installed in the duct work leading from a grinding machine or other source of dust, to the remotely located dust collector. The protection system included a pressure detector or a light activated component, a controller and a suppressant storage and release assembly. If the detector senses an untoward condition in the duct work, the controller sends an electrical command to the detonator to open the rupture disc serving to contain a liquid or powder suppressant in a containment vessel of a type as depicted in one of the previously described vessels. Release of the suppressant in the dust duct serves to stop the reverse flow of hot gasses toward the source of the dust and to suppress any advancing flame front which could cause an explosion at the grinding machine or the like. Here again, unimpeded flow of suppressant from the containment vessel is imperative in the shortest possible time period.

We claim:

1. An explosion protection apparatus adapted to contain a supply of a suppressant and control the release and discharge of the supply of suppressant from the apparatus toward a zone to be protected from an explosion hazard upon receipt of a suppressant delivery command, the apparatus comprising:

storage means for storing the supply of suppressant;

nozzle structure for delivering the supply of suppressant from the storage means toward the zone to be protected, the nozzle structure forming at least a part of the storage means and defining a discharge path within which at least a portion of the supply of suppressant is stored and along which the supply of suppressant travels when discharged from the apparatus; and control means for controlling release of the suppressant from the apparatus for discharge through the nozzle structure only upon receipt by the control means of the suppressant delivery command, the nozzle structure being formed with an internal cross-sectional area which uniformly decreases in size at a substantially constant rate in the direction of suppressant passage along the discharge path, the supply of suppressant being maintained in the nozzle structure in densified form throughout the time of discharge to minimize two-phase phase flow in order to increase the rate of discharge of the supply of suppressant from the apparatus, the nozzle structure and the control means being configured such that the length of any axially extending suppressant delivery part thereof which is of uniform cross-sectional area in the direction of suppressant flow upon release of the suppressant, when divided by the diameter of such uniform diameter part (L/D) is no greater than about 1.

2. An explosion protection apparatus as set forth in claim 1, wherein the nozzle structure is longitudinally curve shaped.

3. An explosion protection apparatus as set forth in claim 1, wherein the nozzle structure is longitudinally straight.

4. An explosion protection apparatus as set forth in claim 1, wherein said nozzle structure is configured and arranged such that in normal use the contained suppressant fills the nozzle structure.

5. An explosion protection apparatus as set forth in claim 1, wherein the nozzle structure is provided with a suppressant discharge orifice at the extremity thereof having the smallest cross-sectional area, said control means comprising a substantially instantaneously openable valve device positioned adjacent said discharge orifice in normally closing relationship thereto.

6. An explosion protection apparatus as set forth in claim 5, wherein said valve device comprises a rupture disc spanning the discharge orifice.

7. An explosion protection apparatus as set forth in claim 6, wherein said control means includes shock wave producing means located in proximity to said disc for effecting rupture and opening of the disc upon actuation of the shock wave producing means.

8. An explosion protection apparatus as set forth in claim 7, wherein said shock wave producing means comprises a detonator located in a position relative to the rupture disc to effect full opening of the rupture disc upon initiation of the detonator.

9. An explosion protection apparatus as set forth in claim 1, wherein said nozzle structure is a reducing elbow.

10. An explosion protection apparatus as set forth in claim 1, wherein said nozzle structure is a reducing concentric.

11. An explosion protection apparatus as set forth in claim 1, wherein said nozzle structure is a reducing eccentric.

12. An explosion protection apparatus as set forth in claim 1, wherein said nozzle structure has a suppressant discharge orifice at the extremity thereof of smallest internal diameter, the opposite end of the structure being provided with cap means thereon for closing that extremity of the structure, said nozzle structure and the cap means in conjunction with said suppressant control release means functioning as means for containing the suppressant until release thereof.

13. An explosion protection apparatus as set forth in claim 1, wherein said nozzle structure has a suppressant discharge orifice at the extremity thereof of smallest internal diameter, there being suppressant containment means at the opposite end of the nozzle structure.

14. An explosion protection apparatus as set forth in claim 13, wherein said containment includes vessel defining means secured to the nozzle structure and being of an internal diameter at least as great as the internal diameter of the nozzle structure at said end thereof opposite the discharge orifice, and cap means for closing the end of the vessel defining means remote from the nozzle structure.

15. An explosion protection apparatus as set forth in claim 14, wherein said vessel defining means includes a pipe section of uniform diameter through-out the length thereof.

16. An explosion protection apparatus as set forth in claim 14, wherein said vessel defining means includes a tubular component of greater overall internal cross-sectional area than the extremity of the nozzle structure to which the component is joined, except for the portion of the component proximal to the nozzle structure which is configured to define a generally uniform transitional surface leading from the part of the component of largest cross-sectional area to the suppression entrance end of the nozzle structure.

17. An explosion protection apparatus as set forth in claim 1, wherein the L/D is less than 0.5.

18. An explosion protection apparatus as set forth in claim 1, wherein the control means includes a rupture disc normally closing the nozzle structure and rupturing means for rupturing the disc upon command, the rupturing means including a detonator, there being an open ended tube extending into the interior of the nozzle structure and terminating with said open end thereof proximal to the disc, said detonator being positioned in the tube adjacent the open end of the tube.

* * * * *